United States Patent [19]

Maisch

[11] Patent Number: 4,714,007

[45] Date of Patent: Dec. 22, 1987

[54] SHUTTLE PISTON CYLINDER

[75] Inventor: Dieter Maisch, Fellbach, Fed. Rep. of Germany

[73] Assignee: Herion-Werke KG, Fellbach, Fed. Rep. of Germany

[21] Appl. No.: 841,091

[22] Filed: Mar. 18, 1986

[30] Foreign Application Priority Data

Mar. 19, 1985 [DE] Fed. Rep. of Germany ..... 3509891

[51] Int. Cl.[4] ..... F01B 29/00

[52] U.S. Cl. ..... 92/88; 277/DIG. 7

[58] Field of Search ..... 92/88; 277/DIG. 7

[56] References Cited

U.S. PATENT DOCUMENTS

| | | | |
|---|---|---|---|
| 4,057,258 | 11/1977 | Ernst | 277/DIG. 7 |
| 4,373,427 | 2/1983 | Garlapaty | 92/88 |
| 4,376,543 | 3/1983 | Sakagami | 277/DIG. 7 |
| 4,481,869 | 11/1984 | Garlapaty | 92/88 |
| 4,519,297 | 5/1985 | Lipinski | 92/88 |
| 4,545,290 | 10/1985 | Lieberman | 92/88 |
| 4,555,980 | 12/1985 | Höglund | 92/88 |
| 4,600,203 | 7/1986 | Miller | 277/DIG. 7 |
| 4,617,857 | 10/1986 | Kedzierski | 92/88 |

FOREIGN PATENT DOCUMENTS

| | | | |
|---|---|---|---|
| 0113790 | 7/1984 | European Pat. Off. | 92/88 |
| 2746718 | 4/1979 | Fed. Rep. of Germany | 277/DIG.7 |
| 3124878 | 12/1982 | Fed. Rep. of Germany | 92/88 |

*Primary Examiner*—Abraham Hershkovitz
*Attorney, Agent, or Firm*—Henry M. Feiereisen

[57] ABSTRACT

A shuttle piston cylinder includes a piston reciprocating in axial direction within the cylinder and carrying a transmission element which transmits the movement of the piston to a consumer and extends through a longitudinal slot of the cylinder barrel. A sealing band extends within the slot with one side stationary arranged against one wall of the slot and including two spaced flexible sealing lips which seal the slot towards the inside and the exterior by lying against the other wall of the slot. The transmission element is provided with slantingly extending shanks which during passage of this element lift the sealing lips from the sealing surfaces. Through inherent prestress, the sealing lips again are arranged on the sealing surfaces after passage of the transmission element.

14 Claims, 5 Drawing Figures

SHUTTLE PISTON CYLINDER

FIELD OF THE INVENTION

The present invention refers to a shuttle piston cylinder in which the movement of the piston is transmitted to an external consumer.

BACKGROUND OF THE INVENTION

In the German Pat. No. 2,162,572 a compressed air cylinder is disclosed which accommodates a reciprocating piston guiding a transmission element which projects beyond the cylinder through a respective longitudinal slot in the cylinder barrel. The slot is sealed by a seal band which is made of magnetizable steel. Arranged along the cylinder are a plurality of magnets which retain the seal band in position and prevent a sagging thereof into the internal space of the cylinder. The use of magnets renders this cylinder complicated and still does not provide a satisfactory sealing of the longitudinal slot towards the outside so that dirt is not prevented from penetrating into the interior.

It has thus been proposed by the German Pat. No. 3,124,878 to provide a shuttle piston cylinder with an inner and an outer seal band of elastomer material. The inner band is provided with a longitudinal rib whose upper portion is wedge-shaped and engages in a longitudinal wedge-shaped groove of the outer band. During movement of the piston e.g. to the left, the rib is continuously disengaged from the groove at the left side of the piston while at the right side thereof is pushed into the groove. A drawback of this prior art is the use of two seal bands in order to provide a sealing also towards the outside. Moreover, the seal bands are made of elastomer material so that their strength and stability are relatively low.

OBJECT OF THE INVENTION

It is thus the principal object of the present invention to provide an improved shuttle piston cylinder obviating the afore-stated drawbacks.

SUMMARY OF THE INVENTION

This object is realized in accordance with the present invention by providing a one-piece sealing band which is permanently anchored in the slot and is provided with two spaced flexible inner and outer sealng lips respectively lying on the cylinder barrel for sealing the slot towards the inside of the cylinder as well as towards the outside. According to another feature of the invention, the transmission element is a bracket with a double bend which projects through the slot and extends between the sealing lips to lift the latter during passage of the bracket. The double bend is preferably provided with a web which radially extends through the slot and is provided with a shank at each end thereof. The shanks extend slantingly away from the sealing band to lift the sealing lips. The sealing band is essentially of I-shaped cross section and includes a bridge connecting the sealing lips in such a manner that a slit is defined between the bridge and each sealing lip. Such an I-shaped sealing band provides the sealing lips with the required flexibility and with sufficient prestress to allow a lifting thereof by the shanks during passage of the bracket and a return of the sealing lips onto the cylinder barrel once the bracket has passed.

The sealing band according to the invention is subjected to minimal friction. The deformation work is also very low because of the minor deformation i.e. because of the small bending angle so that energy losses are kept to a minimum and the durability of the sealing band is increased. Moreover, the sealing band is of simple structure and still reliably seals the slot towards the inside of the cylinder as well as towards the exterior. During pressureless state of the cylinder, the sealing band is securely retained in the slot without loosing its sealing effect.

BRIEF DESCRIPTION OF THE DRAWING

The above objects, features and advantages of the present invention will now be described in more detail with reference to the accompanying drawing in which.

SPECIFIC DESCRIPTION

Figure 1:
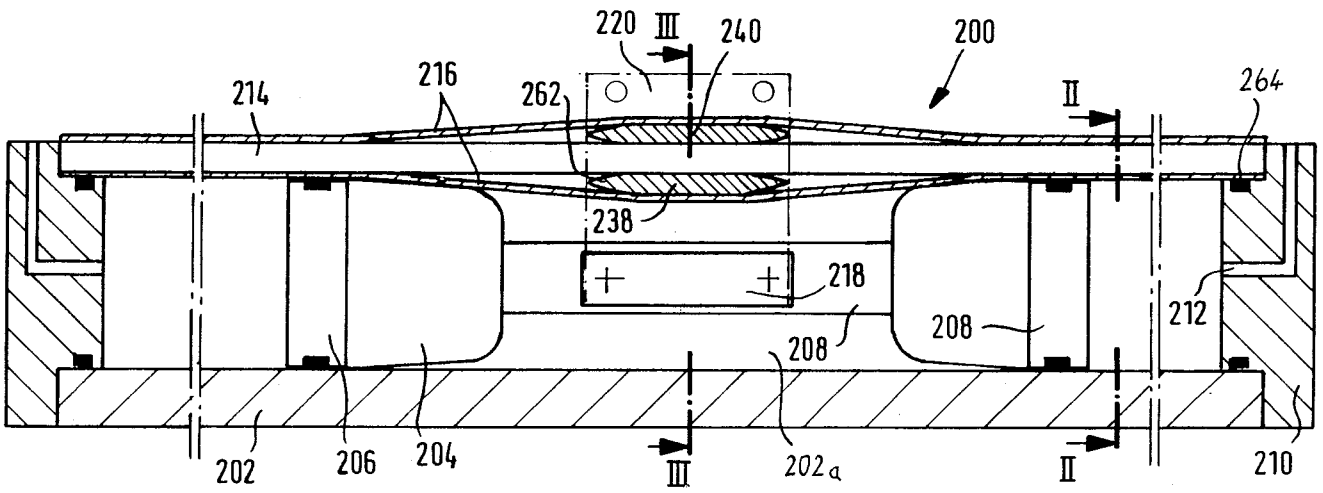
FIG. 1 is a schematic longitudinal section of one embodiment of a shuttle piston cylinder according to the invention.

Referring firstly to FIG. 1, there is shown a shuttle piston cylinder generally designated by reference numeral 200 and including a cylinder barrel 202 defining an internal space **202*a* in which a piston generally designated by reference numeral 204 is guided and reciprocates in axial direction. The piston 204 is provided with two piston heads 206 spaced in axial direction and connected to each other via a bridge 208**.

At its both axial ends, the cylinder barrel 202 is closed by respective end plates or caps 210, each of which accommodates a channel 212 through which a pressure medium e.g. compressed air is supplied and discharged. For reasons of simplicity, the pressure medium source and the connections to channels 212 are not illustrated in detail.

Extending along its apex in axial direction, the cylinder barrel 202 is provided with a continuous longitudinal slot 214 which is defined by longitudinal walls 222,224 of the cylinder barrel 202. As will be described hereinbelow in more detail, the longitudinal slot 214 is sealed by a flexible sealing band 216 whose ends are suitably fixed to the respective caps 210 and sealed by appropriate gaskets 164 to prevent leakage of pressure medium from the internal space **202*a***.

Figure 2:
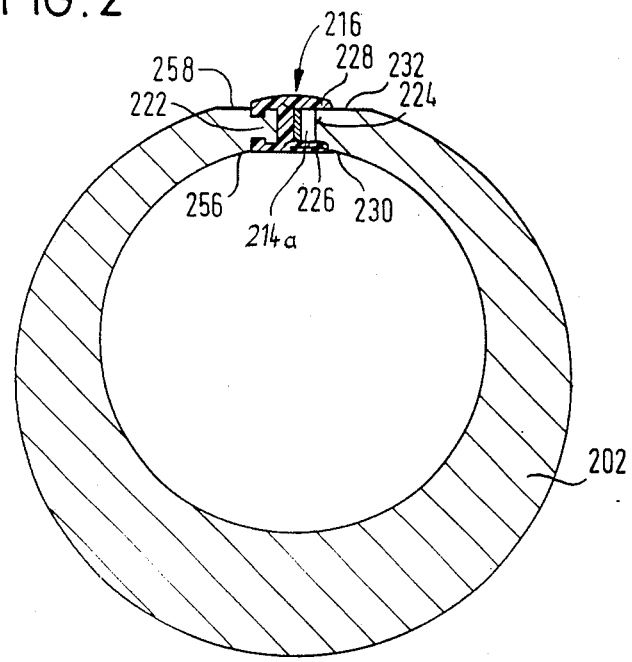
FIG. 2 is a cross sectional view of the shuttle piston cylinder taken along the line 2—2 in FIG. 1.
Figure 3:
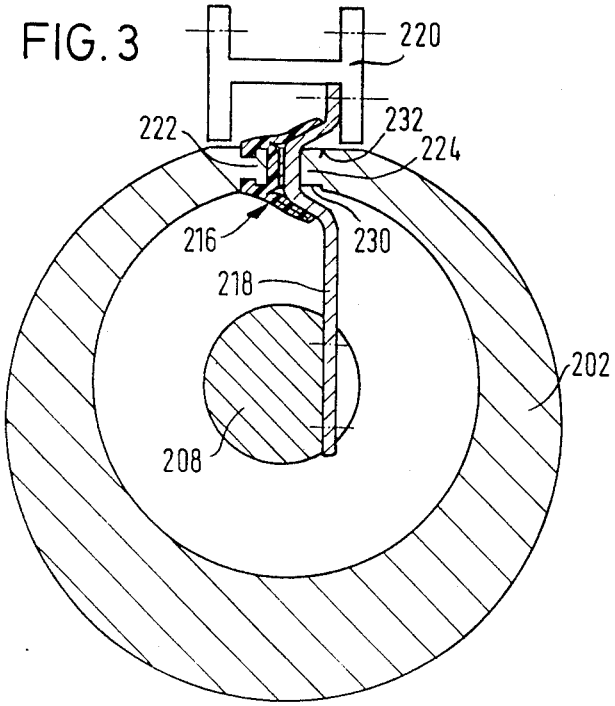
FIG. 3 is a cross sectional view of the shuttle piston cylinder taken along the line 3—3 in FIG. 1.

The cylinder barrel 202 is of varying wall thickness. In FIGS. 2 and 3, it is shown that opposite to the slot 214, the wall thickness is the strongest and decreases towards the slot 214 so that the resistance against expansions caused by the internal pressure is increased.

Fixed to the bridge 208 of the piston 204 e.g. via screws is one end of a power transmission element in form of a bracket 218 which projects radially through the longitudinal slot 214 and beyond the barrel 202. The bracket 218 is attached with its other end to a carriage 220 so that the reciprocating movement of the piston 204 is tansmitted to the carriage 220 and eventually to a further element (not shown) which is connected to the carriage 220 and to be actuated by the shuttle piston cylinder 200.

Turning now to FIG. 2 which illustrates a cross sectional view of the shuttle piston cylinder 200, and in particular the sealing band 216 as extending within the longitudinal slot 214, it can be seen that the cylinder barrel 202 has an outer surface 258 which is flattened at its apex to define a flat surface 232, and an inner surface 256 which at the apex is also flattened and inwardly offset so as to define a respective flat recess 230 (FIG. 3). The sealing band 216 is of essentially I-shaped cross section whose outer sealing lip 228 sits tightly on the outer surface 258 to protect the interior of the shuttle piston cylinder 200 from dirt or other contaminations. The inner sealing lip 226 of the sealing band 216 extends within the recess 230 to seal against the internal pressure within the cylinder barrel 202 during operation and is arranged in such a manner that its exposed face i.e. the side facing the internal space 202*a* flushes essentially with the inner surface 256. The inner sealing lip 226 is connected to the outer sealing lip 228 via a connecting bridge 242 whose one side lies tightly at the longitudinal wall 222 to anchor the sealing band 216 while its other side is arranged at a distance from the facing wall 224 so that a space 214*a* is defined. As is more clearly shown in FIG. 4, the bridge 242 is connected to the sealing lips 226,228 only in vicinity of the wall 222 i.e. in elongation of the wall 222 and is otherwise separated therefrom by respective slits 266 so as to allow the sealing lips 226,228 to be lifted from the respective surfaces 230,258 by the bracket 218 without any loss of sealing action by the sealing band 216. As will be described hereinbelow, such a connection to each other by the bridge 242 provides the sealing lips 226,228 with the required flexibility but still guarantees also a sufficient prestress to allow a return thereof from the elevated position (FIGS. 3 and 4) into the position in which the lips 226,228 lie on the respective surfaces 230,232.

Extending rearwards from the sealing lips 226,228 over the entire length of the sealing band 216 are integrally connected shank-like extensions 252,254. The inner shank 252 rests within the recess 230 while the outer shank 254 extends on the outer surface 258 so that these surfaces are essentially encompassed by the shanks 252,254 under prestress; however, a preferred anchoring is obtained when providing the rearmost end of each shank 252,254 with a longitudinal bead 260 engaging in respective grooves in the cylinder wall 222.

Figure 4:
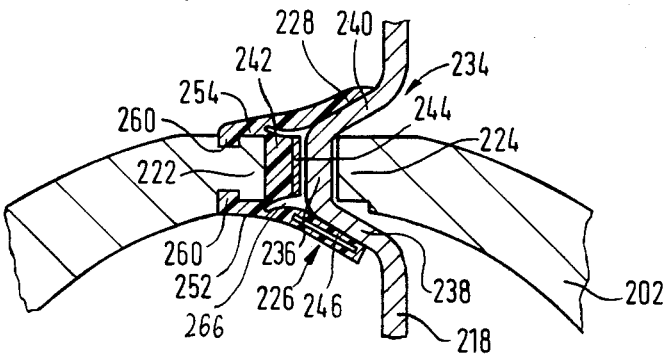
FIG. 4 is a section of the shuttle piston cylinder in accordance with FIG. 3 on an enlarged scale and illustrating the cylinder with its sealing band.

Turning now in particular to FIG. 4, it may be seen that the bracket 218 for transmitting the reciprocating movement of the piston 204 to the carriage 220 is provided with a double bend generally designated by reference numeral 234. The bend 234 is essentially trough-shaped and includes a web 236 which projects essentially radially through the slot 214 and which is connected at each end to a shank 238,240 extending slantingly i.e. at an acute angle away from the sealing band 216. The shanks 238,240 are preferably provided with sloped and rounded edges 262 (FIG. 1) in order to reduce friction and wear during back and forth movement of the bracket 218 and to cause a smooth and continuous lifting of the sealing lips 226,228.

The trough-shaped double bend 234 of the bracket 218 extends radially between the sealing lips 226,228 which rest on the shanks 238,240 and are thus lifted from the surfaces 230,258 when the bracket 218 passes by. The shanks 238,240 are inclined as far as constructively feasible relative to the web 236 in order to keep the deformation work of the sealing lips 226,228 as low as possible.

Each shank 238,240 defines with a horizontal an angle e.g. between 15° and 45°.

In FIG. 4, it is shown that the bridge 242 of the sealing band 216 is provided with a metal band 244 along its surface facing the wall 224 or the web 236 of the bend 234. The metal band 244 is e.g. vulcanized to the bridge 242 and prevents a direct contact of the latter with the web 236 and thus friction and wear therebetween. In addition, the metal band 244 may be used as displacement transducer for indicating the movement of the piston 204 and thus of the carriage 220 e.g. through measuring its electric resistance by using a suitable slider or through digital measurement by subdividing the metal band 244 in segments and using e.g. a Hall probe. Alternatively, also a magnetostrictive measurement can be applied.

Instead of using the metal band 244, it is also feasible to provide a suitable e.g. glass-fiber reinforced or carbon-fiber reinforced plastic band which, if necessary, contains metal particles to achieve electric conductivity.

Figure 5:
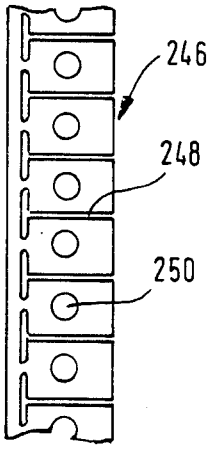
FIG. 5 is a top view of a metal band for reinforcing the sealing band.

For its reinforcement, the inner sealing lip 226 is provided with a metal band 246 which may e.g. be centrally injected into the sealing lip 226. As is shown in FIG. 5, the metal band 246 is provided with holes 250 and with T-shaped slots 248 or straight slots (not shown) between adjacent two holes 250 in order to increase the flexibility of the metal band 246 and thus of the inner sealing lip 226.

During operation of the shuttle piston cylinder 220, the reciprocating piston 204 will cause the bracket 218 and thus the carriage 220 to follow its movement. The bracket 218 with its bend 234 moves back and forth within the space 214*a* and thus lifts in the area between the piston heads 206 with its shanks 238,240 the sealing lips 226,228 from the surfaces 230,232. The sealing band 216 lies continuously with its one side along the wall 222 and thus is anchored stationary within the slot 214 as the slits 266 allow the spreading of the sealing lips 226,228 during reciprocation of the piston 204 and of the bracket 218. In front of and behiind the brakcet 218, the sealing lips 226,228 lie again on the sealing surfaces 230,232.

The sealing lip 226 is forced into the recess 230 especially through the internal pressure in the space 202*a* but also through sufficient inherent prestress which also causes the outer sealing lip 228 to be pressed against the outer surface 232. Thus, the sealing lips 226,228 after being lifted by the bracket 218 automatically return against the respective sealing surfaces 230,232 when the shanks 238,240 move past the respective area.

The sealing band 216 is easily and quickly incorporated into the shuttle piston cylinder 200 by simply pushing or snapping the beads 260 of the shanks 252,254 into the pertaining grooves in the wall 222 of the cylinder barrel 202.

While the invention has been illustrated and described as embodied in a Shuttle Piston Cylinder, it is not intended to be limited to the details shown since various modifications and structural changes may be made without departing in any way from the spirit of my present invention.

What is claimed as new and desired to be protected by Letters Patent is set forth in the appended claims:

I claim:

1. A shuttle piston cylinder device, comprising:

a cylinder defining an axis and having a cylinder barrel provided with a longitudinal slot extending in axial direction thereof;

a piston reciprocating in axial direction within said cylinder;

a transmission element connected to said piston and projecting through said slot for transmitting the movement of said piston; and a one-piece sealing band permanently anchored within said slot and provided with two spaced flexible inner and outer sealing lips lying against said cylinder barrel for sealing said slot towards the inside of said cylinder as well as towards the exterior, said sealing lips being liftable off said cylinder barrel by said transmission element without moving said sealing band from said slot, said transmission element being a bracket having a double bend extending between said sealing lips to lift the latter from said cylinder barrel and including a web extending essentially radially through said longitudinal slot and two shanks connected to said web at its respective ends and extending slantingly away from said sealing band, said sealing lips lying on said shanks when being lifted.

2. A cylinder device as defined in claim 1 wherein said cylinder barrel defines two opposing cylinder walls confining said slot, said sealing band being anchored permanently with one side to one of said cylinder walls.

3. A cylinder device as defined in claim 2 wherein each of said cylinder walls is provided with an inner surface and an outer surface, said sealing lips lying against said inner and outer surfaces of said other cylinder wall.

4. A cylinder device as defined in claim 3 wherein said inner and outer surfaces are each flattened.

5. A cylinder device as defined in claim 4 wherein said flattened inner surface is inwardly offset to define a recess for said inner sealing lip.

6. A cylinder device as defined in claim 1 wherein each of said shanks extends at an angle between 15° and 45° with respect to a horizontal.

7. A cylinder device as defined in claim 2 wherein said sealing band is of I-shaped cross section and includes a bridge connecting said sealing lips and extending with one side along said one cylinder wall within said longitudinal slot.

8. A cylinder device as defined in claim 7 wherein said bridge defined with each sealing lip a slit so as to allow said sealing lips to be lifted without altering the position of said bridge.

9. A cylinder device as defined in claim 7, and further comprising a metal band, said bridge of said sealing band being provided with said metal band at its side facing said other cylinder wall and said transmission element to reduce friction and wear.

10. A cylinder device as defined in claim 7 wherein said sealing band is further provided with a shank in extension of each sealing lip so as to encompass said one cylinder wall from the inside and from the outside.

11. A cylinder device as defined in claim 10 wherein said one cylinder wall is provided with an inner surface and an outer surface, each of said shanks of said sealing band being provided with a longitudinal bead engaging in a respective groove in said inner and outer surfaces of said one cylinder wall.

12. A cylinder device as defined in claim 1, and further comprising a metal band incorporated within said inner sealing lip for reinforcing the latter.

13. A cylinder device as defined in claim 12 wherein said metal band is provided with a plurality of slots for increasing the flexibility and the connection with said inner sealing lip.

14. A cylinder device as defined in claim 12 wherein said metal band is provided wtih a plurality of holes for increasing the flexibility and the connection with said inner sealing lip.

* * * * *